United States Patent [19]

Semenov et al.

[11] 4,241,245

[45] Dec. 23, 1980

[54] PROGRAMMED SWITCHING DEVICE

[76] Inventors: Stepan S. Semenov, 3 Sreletsky pereulok, 2a, kv. 64; Volf S. Pevzner, prospekt Vernadskogo, 125, kv. 268, both of Moscow, U.S.S.R.

[21] Appl. No.: 941,072

[22] Filed: Sep. 11, 1978

[51] Int. Cl.[3] ..... H01H 43/00

[52] U.S. Cl. ..... 200/38 R; 200/38 B; 200/38 BA

[58] Field of Search ..... 200/38 R, 38 A, 38 F, 200/38 FA, 38 FB, 38 B, 38 BA, 38 L, 38 CA, 38 D, 38 DA, 38 DB, 38 DC, 38 E, 46, 30 R, 31 R; 307/141

[56] References Cited

U.S. PATENT DOCUMENTS

| | | | |
|---|---|---|---|
| 3,002,060 | 9/1961 | Laviana | 200/30 R X |
| 3,721,780 | 3/1973 | Kelly et al. | 200/153 T |
| 4,075,506 | 2/1978 | Nakata | 307/141 |

*Primary Examiner*—J. V. Truhe

*Assistant Examiner*—Morris Ginsburg

*Attorney, Agent, or Firm*—Fleit & Jacobson

[57] ABSTRACT

A programmed switching device for setting angular positions of shafts of mechanisms and machines comprises a shaft, a cam-and-lever mechanism for operating those particular switching devices which correspond to the angular position of the shaft being set, and a setting mechanism interconnected with the shaft and the cam-and-lever mechanism. Discs are rigidly secured on the shaft, each disc having a slot, and a dividing element is movably installed on the shaft, linked kinematically with the shaft of the mechanism and provided with cutouts on the side surface, one for the rotation plane of each disc. Cams are installed on an axle so that each cam can rotate in the rotation plane of the corresponding disc. The dimensions of the cutouts and slots correspond to the dimensions of the rollers in order to permit interaction of the discs with the switching elements, each of said elements being located in the rotation plane of the corresponding disc.

18 Claims, 7 Drawing Figures

PROGRAMMED SWITCHING DEVICE

FIELD OF APPLICATION

The present invention relates to a device for programmed control of the position of shafts of a mechanism or machine, and more particularly it relates to programmed switching devices.

The invention can be utilized for setting angular coordinates in metal-cutting machines such as jig boring machines, horizontal boring machines, milling machines, turning latches, etc.; for setting linear coordinates with the use of motion screws of a machine tool or a rack-and-gear drive; for automatic the metal-cutting machines such as drilling machines, turning latches, jig boring machines, horizontal boring machines, milling machines, etc.

In all the machines listed above, the device can be employed on the capacity of a sensor of a series of fixed angular positions of a shaft or a sensor of a series of fixed positions of a progressively-moving member.

The device can be used in any mechanism or machine calling for remote setting of a shaft or another movable member to any one of a series of fixed positions. The device can also prove useful in a master switch for controlling automatic production lines, transport installations, and other kinds of equipment.

BACKGROUND OF THE INVENTION

Known in the prior art are programmed switching devices comprising a shaft connected with microswitches by a kinematic linkage, e.g. a cam, and installed in a casing. The shaft has the form of a motion screw with longitudinal splines and carries a nut connected by a pin with a longitudinal guiding cutout in the casing. The cam is connected with the nut by a bearing, while its connection with the screw splines is by means of lobes (see, for example, U.S. Pat. No. 3,721,780).

As the shaft rotates, the nut moves over the motion screw together with the cam. The moving cam presses the actuating elements of the microswitches, the signals of which correspond to certain angular positions of the shaft.

The prior art device fails to ensure delivery of information in any position of the shaft, for example, in the intervals between the positions set by the operation of adjacent microswitches, because the size of these intervals depends on the minimum distance required for mounting the actuating elements of the adjacent microswitches on the path of the cam. Besides, the device does not deliver information about the sign of mismatching between the actual position of the shaft and the position set by the operation of the corresponding microswitch.

Another prior art programmed switching device comprises a main shaft and an intermediate shaft which are interconnected by a worm drive and accommodated in a casing. The intermediate shaft carries a number of cams, each provided with a lobe. Located between the actuating element of each microswitch and the corresponding cam is a tappet articulated to the casing and carrying a roller which rests on the cam surface. The device incorporates a setting mechanism which changes the positions of the main shaft at which the microswitches operate and has a pin located on the intermediate shaft; the cam of the setting mechanism is made in the form of a washer with a central hole for the passage of the intermediate shaft and with holes which interact with the pin under the effect of a spring.

The tappet roller is mounted on a carriage which is connected with the tappet by an adjusting screw and moves along guides. The microswitches are rigidly secured in line on the casing of the device.

During operation of the device, rotation of the main shaft is transmitted by the worm drive to the intermediate shaft and, depending on the turning angle of the intermediate shaft, the cams press the actuating elements of the microswitches via the tappets, thus causing the microswitches to operate. The electric signals of the microswitches, sent at the moment of their operation, determine the positions of the main shaft.

The basic disadvantage of this device lies in its low accuracy, caused by the fact that the main and intermediate shafts are connected by a reduction gearing.

BRIEF DESCRIPTION OF THE INVENTION

An object of the present invention lies in providing a programmed switching device which would ensure high accuracy of operation, sufficient for this device to be used as a precision sensor of the fixed positions of shafts.

Another object of the invention lies in reducing the overall dimensions of the device.

Still another object of the invention lies in decreasing the moment of resistance on the intermediate shaft.

A further object of the invention lies in widening the working range of rotation of the shaft of a mechanism or machine while retaining the attained operating accuracy of the device.

This is achieved by providing a programmed switching device for setting angular positions of the shafts of mechanisms or machines, comprising a number of switching elements, a shaft of its own linked kinematically with the shaft of the mechanism or machine the angular position of which is to be set, and a setting mechanism interconnected with the shaft and with the cam-and-lever mechanism for actuating the switching element which corresponds to the required angular position of the shaft of a mechanism or machine. According to the invention, the setting mechanism comprises discs rigidly secured on the shaft, each disc having a slot, and a movably installed dividing element linked kinematically with the shaft of the device, and dividing element accommodating the discs and having cutouts on the side surface, one cutout in the rotation plane of each disc. The cams of the cam-and-lever mechanism are installed on an axle so that each cam can rotate in the rotation plane of the corresponding disc, the size of the cutouts in the dividing element and the size of the corresponding slots in the discs matching with the size of the roller of the cam-and-lever mechanism to permit interaction of the discs with the corresponding switching elements, each of the latter being arranged in the rotation plane of the corresponding disc.

The dividing element can be made in the form of a drum or sleeve.

The kinematic linkage between the dividing element and the shaft of the device may comprise an internal gearing, and it is practicable that the dividing element should be installed eccentrically with respect to the shaft.

It is highly practicable that the setting mechanism should have at least one more dividing element, each installed eccentrically with respect to the shaft and kinematically linked with the shaft by an internal gearing.

The internal gearing may comprise a gear secured on the shaft inside the dividing element and a corresponding gear rim secured on the inner side of the dividing element, or a perforated portion of the side surface of the dividing element meshing with the corresponding gear.

It is practicable that at least one dividing element and a corresponding gear drive from the shaft to this dividing element should be installed side by side with each disc, and that the discs, dividing elements and gears should be grouped on the shaft, that said groups should be separated from one another by washers installed on the shaft without freedom of rotation, and that the length of the cam rollers of the cam-and-lever mechanism should be selected so as to overlap the disc and the dividing elements of the same group to which the disc belongs.

Each dividing element can be made in the form of a flat ring which is integral with the gear rim of the internal gearing.

It is convenient to install the dividing elements in aligning rollers, the axles of which are secured in the casing of the device and are parallel to the shaft of said device.

The dimensions of the cutouts in the dividing elements should be larger than those of the slots in the discs.

It is practicable that the speed ratio of the kinematic linkage from the shaft of a mechanism or machine to the shaft of the device should differ from the speed ratio of the kinematic linkage from the shaft of a mechanism or machine to the dividing element, and should be selected so that the cutout of the dividing element would coincide with the corresponding slot of the disc only once within the working range of rotation of the shaft of a mechanism or machine.

The programming switching device realized in accordance with the present invention feature such advantages over the existing analogs which enable them to be used in the capacity of precision sensors of a series of fixed angular positions of the working elements of machine tools; they promote the accuracy of information about the position of the shaft of a mechanism or machine in accordance with the increased speed ratio from the shaft of a mechanism or machine to the shaft of the device because the greater the speed ratio, the higher the accuracy that can be obtained from the device; they also deliver information about the sign of mismatching between the actual position of the shaft of a mechanism or machine and the preset position within the entire range of its movement through a single accurate information channel.

BRIEF DESCRIPTION OF DRAWINGS

Now the invention will be described in detail by way of examples with reference to the accompanying drawings, in which.

DETAILED DESCRIPTION OF THE INVENTION

Figure 1:
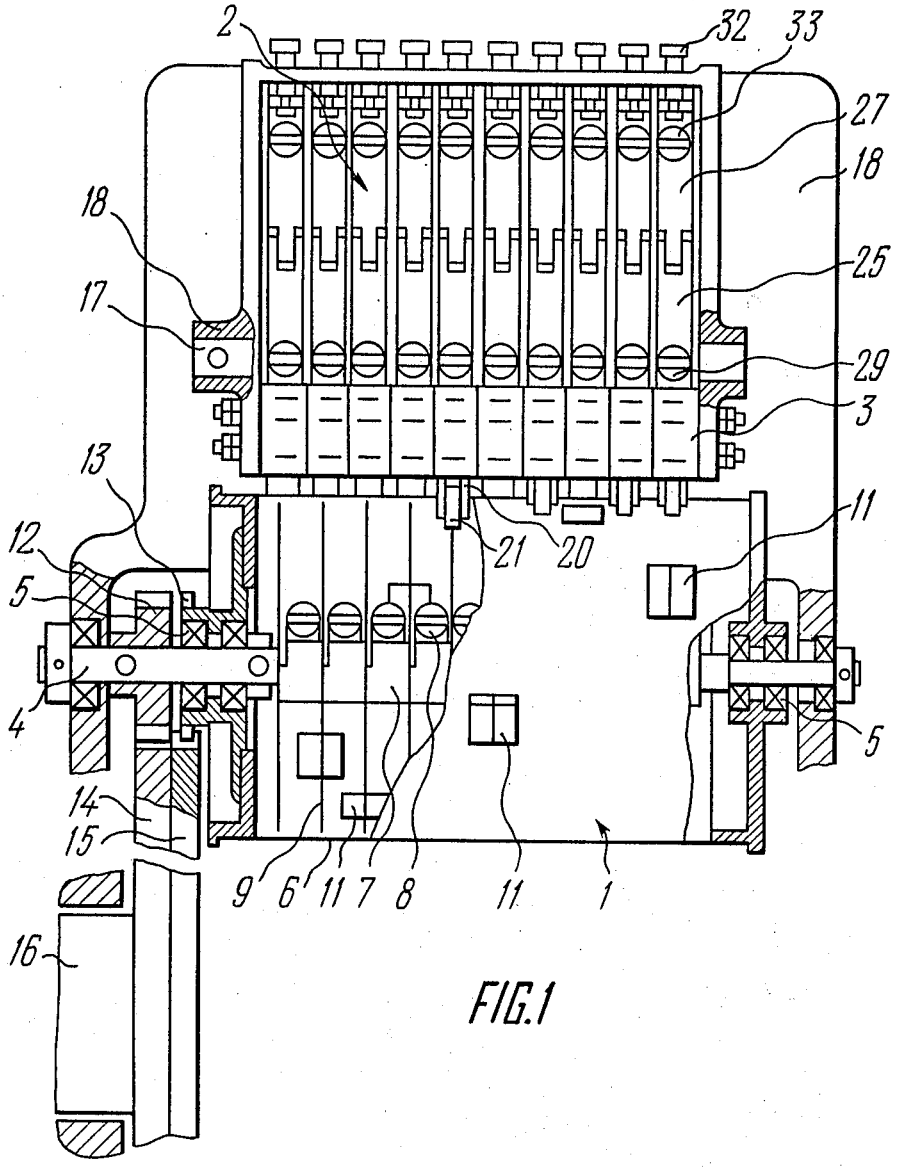
FIG. 1 is a partial longitudinal section of the programmed switching device according to the invention.

The programmed switching device comprises a setting mechanism 1 (FIGS. 1,2), a cam-and-lever mechanism 2 and switching elements in the form of microswitches 3.

The setting mechanism 1 comprises a shaft 4 carrying a dividing element 6 mounted on bearings 5. Secured by clamps 7 with screws 8 on the shaft 4 in the space of the dividing element 6 are discs 9, each having a slot 10 (FIG. 2). The side surface of the dividing element 6 has cutouts 11, one for the rotation plane of each disc 9. The shaft 4 and the dividing element 6 carry, respectively, gears 12 and 13 (FIG. 1) meshing with the gear wheels 14 and 15, respectively, of the shaft 16 of the mechanism or machine. The transmission between the gear 12 and gear wheel 14 is of the self-adjusting type with automatically taken-up play (not shown in the drawing).

The cam-and-lever mechanism 2 comprises an axle 17 secured in the casing 18 of the device parallel to the shaft 4. Cams 20 (FIG. 2) are installed on the bearings 19 of the axle 17. Each cam 20 is arranged in the rotation plane of the corresponding disc 9 and is provided with a roller 21. The spring 22 holds the cam 20 in positions such that the roller 21 is pressed against the side surface of the dividing element 6 or against the surface of the disc 9 if the cutout 11 comes under the roller 21. The contour of the cam 20 is shaped in the form of sectors with two radii $R_1$ and $R_2$ and with the centre on the axle 17. The point of junction between the sectors shaped by the radii $R_1$ and $R_2$ forms a step 23. Located between the actuating element 24 of each microswitch 3 fixed rigidly on the casing 18 of the device and the corresponding cam 20 is a tappet 25. The tappet 25 is connected by a hinge 26 with a bracket 27 and has a roller 28 which rests on the surface of the cam 20. The tappet 25 is provided with an adjusting screw 29 and a cutout 30. The bracket 27 is connected with the casing 18 of the device by means of a guide 31 and an adjusting screw 32, and is secured with a screw 33.

The diameters of the gear wheels 14 and 15 of the mechanism or machine exceed by many times those of the gears 12 and 13 of the device, while the speed ratio between the shaft of the mechanism or machine and the shaft 4 of the device is not equal to the speed ratio between the shaft of the mechanism or machine and the dividing element 6.

The programmed switching device functions as follows.

During rotation of the shaft 16 of the mechanism or machine, due to inequality between the speed ratio from the shaft 16 of the mechanism or machine to the shaft 4 of the device and the speed ratio from the shaft 16 of the mechanism or machine to the dividing element 6, there arises an angular displacement between the shaft 4 and the dividing element 6 and, correspondingly, the cutouts 11 move in the side surface of the dividing element 6 with relation to the slots 10 of the discs 9. The numbers of gear teeth are selected in such a manner that, at a preset speed ratio from the shaft 16 of the mechanism or machine to the shaft 4 of the device, the cutouts 11 coincide with the slots 10 of the corresponding discs 9 only once within the entire rotation range of the shaft 16 of the mechanism or machine. As the shaft 16 of the mechanism or machine rotates counterclockwise, the discs 9 and the dividing element 6 (FIG. 2) rotate clockwise, the rollers 21 roll over the side surface of the dividing element 6 which prevents the rollers 21 from sinking into the slots 10 of the disc 9, and during each revolution of the dividing element 6 said rollers snap into the cutouts 11, resting on the surface of the discs 9. When one of the cutouts 11 of the dividing element 6 coincides with the slot 10 of the disc 9, the spring 22 forces the roller 21 of the cam 20 in position I to engage the slot 10 of the disc 9 and, moving together with it, said roller 21 is thrown to position II. When the cam 20 is moved from position I to position II, the roller 28 of the tappet 25 transitions from the cam contour of radius $R_1$ onto the cam contour of radius $R_2$, passing over the stem 23, forcing the tappet 25 to press the actuating element 24 of the microswitch 3 and thus causing the latter to operate. The microswitch 3 sends a signal indicating that the shaft 16 of the mechanism or machine has reached the preset angular position.

During rotation of the shaft 16 of the mechanism or machine clockwise, when the cutouts 11 line up with the slots 10, the cams 20 are shifted from position II to position I, actuating the microswitches 3 on the way, as described above.

The change of the fixed angular positions of the shaft is carried out by replacement of the dividing element 6 (or only that part of it which forms its side surface) and by angular displacement of the discs 9 on the shaft 4, first loosening the screws 8 of the clamps 7. Correct matching of the preset position of the shaft 16 of the mechanism or machine with the position of the actuating element 24, corresponding to the moment of operation of the microswitch 3 corresponding to this position of the shaft 16, is carried out by shifting the bracket 27 over the guide 31, with the screw 33 being loosened by means of the adjusting screw 32.

The dividing element 6 is made in the form of a drum, through which passes the shaft 4 of the device with the discs 9.

Figure 3:
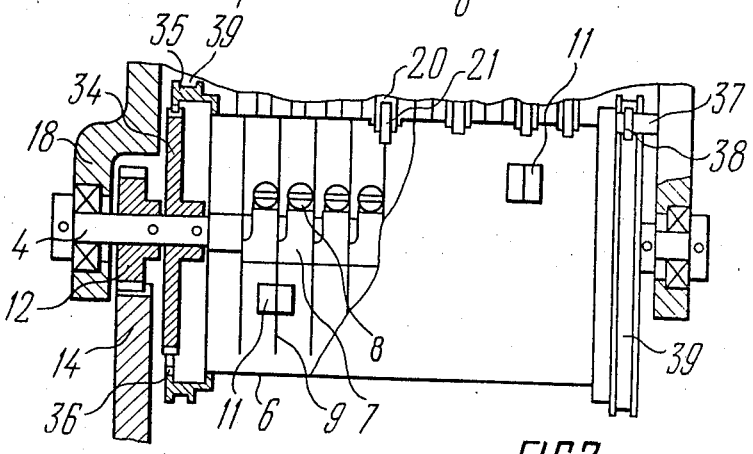
FIG. 3 is a partial longitudinal section of the programmed switching device with an internal gearing, according to the invention.

The embodiment of the programmed switching device shown in FIG. 3 comprises an internal gearing consisting of two external gears 34 and two gear wheels 35 with gear rims 36. The gears 34 are secured on the dividing element 6 which is made in the form of a sleeve and installed eccentrically with respect to the shaft 4 so that the side wall of said element contacts the external surfaces of the discs 9. Secured on the casing 18 are four axles 37 which carry aligning rollers 38. The rollers 38 snap into the grooves 39 and, together with the discs 9, align the dividing element 6 and guard it against axial displacements.

The play between the gear 12 and the gear wheel 14 can be taken up in advance by any known means.

The programmed switching device illustrated in FIG. 3 functions similarly to the device described above.

Figure 4:
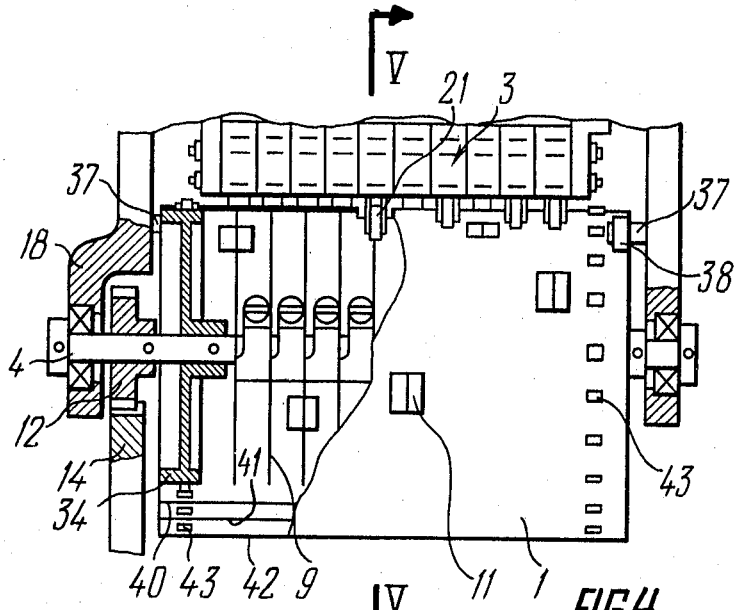
FIG. 4 is a partial longitudinal section of the programmed switching device with several dividing elements, according to the invention.
Figure 5:
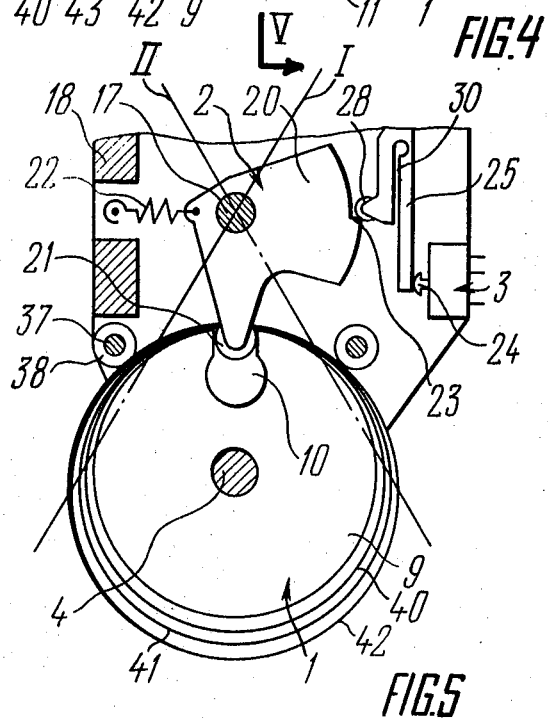
FIG. 5—same device, a section taken along line V—V in FIG. 4.

Shown in FIGS. 4 and 5 is a version of the programmed switching device with three dividing elements made in the form of sleeves 40,41 and 42 arranged eccentrically relative to the shaft 4. Each sleeve 40,41 and 42 is connected with the shaft 4 of the device by an internal gearing consisting of two gears 34 secured on the shaft 4, and perforated portions of the sleeves 40,41 and 42 corresponding to each gear 34, said perforated portions having holes 43 which, together with the gears 34, form an internal gearing. At a relatively small number of switching elements and, consequently, at a relatively small length of the sleeves 40–42, it is expedient to have only one gear 34 and, correspondingly, one perforated portion with holes 43 on each sleeve 40,41 and 42. The casing 18 of the device carries axles 37 with aligning rollers 38 which keep the sleeves 40–42 against radial movements. Axial motions of the sleeves 40–42 are prevented by the elements of the gear drives.

The programmed switching device shown in FIGS. 4 and 5 functions as follows.

During rotation of the gear wheel 14 secured on the shaft 16 of the mechanism or machine, there arise relative angular displacements between the shaft 4 of the device and the sleeves 40–42, and between the sleeves 40–42 proper and, correspondingly, displacements of the cutouts 11 of the sleeves 40–42 relative to one another and relative to the slots 10 of the discs 9. The number of teeth of the gears 34 and the numbers of holes 43 in each sleeve 40–42 are selected so that, at the preset speed ratio between the shaft 16 of the mechanism or machine and the shaft 4 of the device, the cutouts 11 of the sleeves 40–42 simultaneously coincide with the corresponding slots 10 of the discs 9 only once within the entire rotation range of the shaft 16. When one of the cutouts 11 lines up with the corresponding slot 10, the roller 21 of the cam 20, actuated by the spring 22, engages the slot 10 of the disc 9 and, moving together with it, is transitioned from position I to position II (FIG. 5) or, vice versa, depending on the sense of rotation of the shaft 4, thus actuating the corresponding microswitch 3 and sending a signal indicating that the shaft 16 has reached the required angular position, similarly to the process described above.

The program of the present fixed positions of the shaft 16 is changed by replacing the sleeves 40–42, and by setting the angular displacement of the discs 9 on the shaft 4.

Figure 7:
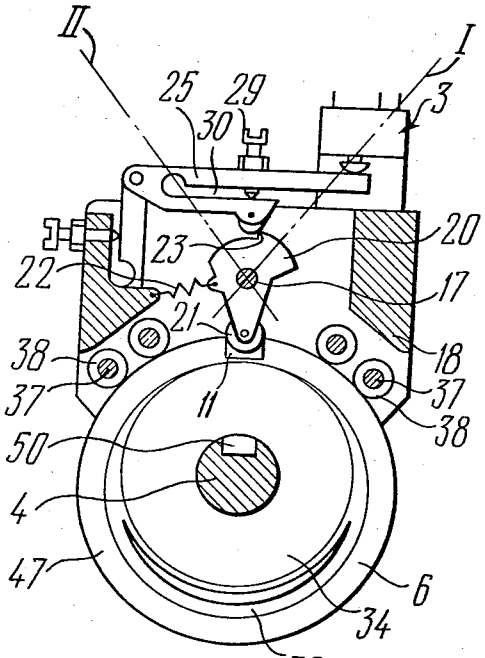
FIG. 7—same device, a section taken along line VII—VII in FIG. 6.
Figure 6:
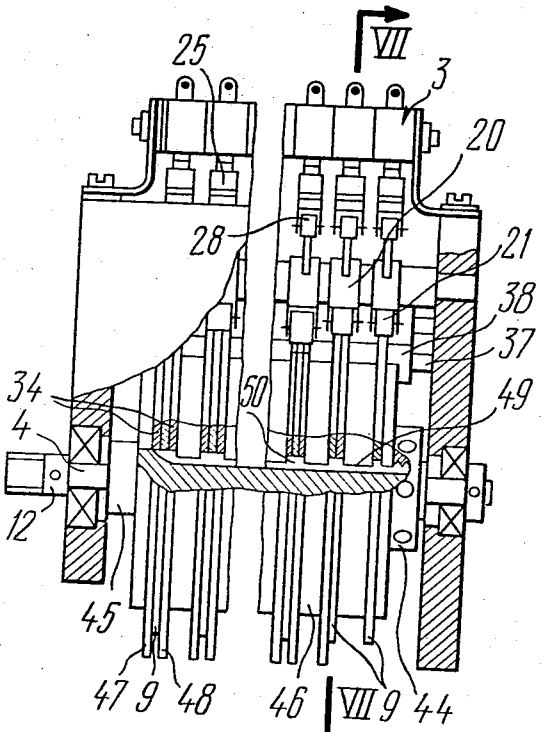
FIG. 6 is a partial longitudinal section of the programmed switching device with grouped elements, according to the invention.

Illustrated in FIGS. 6 and 7 are the drawings of the programmed switching device whose the setting mechanism 1 is made readjustable.

Fixed rigidly on the shaft 4 of the device by means of a nut 4 and shoulder 45 are discs 9, gears 34 and washers 46. Installed side by side with each disc 9 is at least one dividing element and a gear 34 corresponding to each dividing element. In this example, the dividing elements are made in the form of flat rings 47 and 48 with cutouts 11, said rings being integral with the gear rims 36 of the internal gearing. Each disc 9 with the adjoining rings 47 and 48 and gears 34 makes up a group. Each group may include several rings 47,48 and the corresponding number of gears 34. The rings 47 and 48 are installed with certain clearances between the washers 46 and discs 9. The rings 47,48 are arranged eccentrically relative to the shaft 4 in four aligning rollers 38, the axles 37 of which are secured in the casing 18 parallel to the shaft 4. The washers 46 are installed between the groups. Each washer 46 has a projection 49 which enters the longitudinal slot 50 of the shaft 4, thus preventing the washer 46 from rotating on the shaft 4. The rollers 21 of the cams 20 of the cam-and-lever mechanism 2 are made so that each of them overlaps in length the disc 9 and the rings 47 and 48 of the corresponding group.

The programmed switching device illustrated in FIGS. 6 and 7 functions as follows.

During rotation of the gear wheel 14 secured on the shaft 16 and of the gear 12 meshing with said gear wheel 14, there arise relative angular motions between the discs 9 secured on the shaft 4 of the device and the rings 47,48, on the one hand, and between the rings 47,48, on the other hand; correspondingly, displacements of the cutouts 11 of the rings 47,48 relative to each other and relative to the slots 10 of the discs 9 occur.

The numbers of teeth of the gears 34, gear rims 36 and rings 47,48 are selected so that, at the required speed ratio between the shaft 16 of the mechanism or machine and the shaft 4 of the device, the cutouts 11 of the rings 47,48 coincide simultaneously with the corresponding slots 10 of the discs 9 only once within the entire working range of rotation of the shaft 16 of the mechanism or machine. At the moment when the cutouts 11 of the rings 47,48 coincide simultaneously with the corresponding slots 10 of the discs 9, the roller 21 of the cam 20 is forced by the spring 22 into meshing engagement with the slot 10 of the disc 9 and, moving jointly with the latter, is the cam 20 transitioned from position I to position II (FIG. 7) or vice versa, depending on the sense of rotation of the shaft 16, thereby actuating the corresponding microswitch 3 and sending a signal indicating that the shaft 16 of the mechanism or machine has reached the preset angular position, similarly as in the process described above.

The program of the preset fixed positions of the shaft 16 of the mechanism or machine is changed by the angular motion of the discs 9 and rings 47,48 together with the corresponding gears 34 of the shaft 4, first loosening the nut 44.

Let us now consider the examples of selecting the speed ratios between the shaft 16 of the mechanism or machine and the shaft 4 of the device, and between the shaft 16 of the mechanism or machine and the dividing element 6 required to ensure that the cutouts 11 of the dividing element 6 coincide with the slots 10 of the corresponding discs 9 of the device only once within the working range of rotation of the shaft 16 of the mechanism or machine.

EXAMPLE 1.

Figure 2:
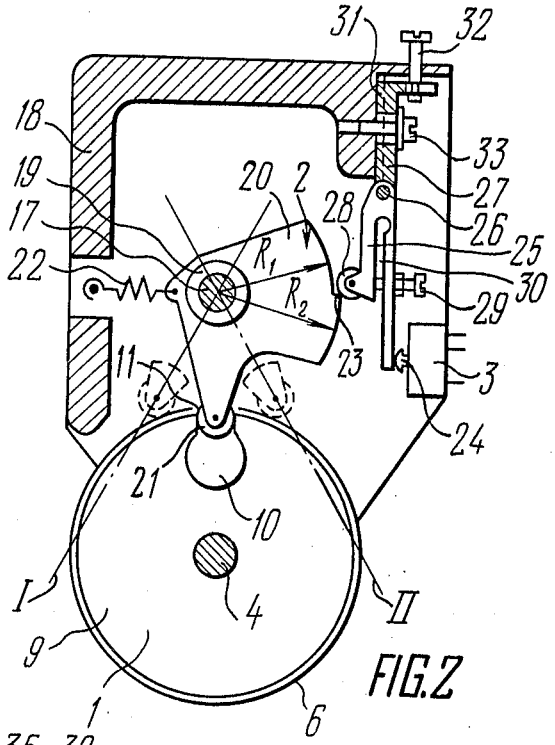
FIG. 2—same, a sectionalized side view.

A programmed switching device with the dividing element in the form of a drum (FIGS. 1,2).

The preset working range of rotation of the shaft 16 of the mechanism or machine $$Q=360°$$

The preset speed ratio from the shaft 16 of a mechanism or machine to the shaft 4 of the device $$i_1=z_1/z_2=1120/35$$

The speed ratio from the shaft 16 of a mechanism or machine to the dividing element 6 (drum)

$$i_2=z_3/z_4=1120/36,$$

where:

$z_1$ and $z_3$ = numbers of teeth of the gear wheels 14,15 secured on the shaft 16 of a mechanism or machine. The gear wheel 15 with the number of teeth $Z_3$ is made with corrected teeth;

$z_2$ = number of teeth of the gear 12 secured on the shaft 4 of the device;

$z_4$ = number of teeth of the gear 13 secured on the dividing element 6.

EXAMPLE 2.

A programmed switching device with the dividing element in the form of a sleeve (FIG. 3)

$$Q=360°$$

$$i_1=z_1/z_2=1120/35;$$

$$i_2=(z_1/z_2).(z_3/z_4)=(1120/35).(82/88);$$

where:

$z_1$ = number of teeth of the gear wheel 14 secured on the shaft of the mechanism or machine;

$z_2$ = number of teeth of the gear 12 secured on the shaft 4 of the device;

$z_3$ = number of teeth of the gear 34 secured on the shaft 4 of the device and meshing with the sleeve 6;

$z_4$ = number of teeth of the gear rim 36.

EXAMPLE 3.

A programmed switching device with two dividing elements in the form of sleeves (FIGS. 4,5)

$$Q=140 \text{ revolutions}$$

$$i_1=1;$$

$$i_2'=z_1/z_2=9/11;$$

$$i_2''=z_1/z_2=9/13,$$

where:

$i_2'$ = speed ratio from the shaft 16 of the mechanism or machine to the inner sleeve 40;

$i_2''$ = speed ratio from the shaft 16 of the mechanism or machine to the sleeve 41;

$z_1$ = number of teeth of the gear 12 secured on the shaft 4 of the device;

$z_2$ and $z_3$ = number of holes in the perforated portions, of the sleeves 40 and 41, respectively.

EXAMPLE 4.

A programmed switching device with three dividing elements in the form of rings (FIGS. 6 and 7).

$$Q=100{,}000 \text{ revolutions}$$

$$i_1=1;$$

$$i_2'=z_1/z_2=82/88;$$

$$i_2''=z_1/z_3=82/94;$$

$$i_2'''=z_1/z_4=82/102;$$

where $i_2'$, $i_2''$, $i_2'''$ = speed ratios between the shaft 16 of the mechanism or machine and the first, second and third rings of the same group;

$z_1$ = number of teeth of the gears 34 secured on the shaft of the device;

$z_2$, $z_3$ and $z_4$ = numbers of teeth of the gear rims 36 of the rings in one group meshing with the gears 34 secured on the shaft of the device.

The present invention improves the accuracy of information readout and the reception of information relating to the sign of mismatch between the actual position of the shaft and its preset position.

The invention can be used for developing/implementing extremely simple automatic control systems for machine tools.

The device can be connected either with the shaft of the mechanism or machine, or with the progressively moving elements of mechanisms or machines, for which purpose the latter must be provided with gear racks or motion screws.

It permits changing the program of the set fixed positions of the shaft of the mechanism or machine; for this purpose, the wall of the drum is made replaceable, for example, from sheet material, and the discs on the shaft of the device are secured by clamps.

The device ensures a reduction in the moment on the shaft due to eccentric installation of the dividing element and, as a result, due to a reduction practically to zero of the clearance between the inside surface of the sleeve and the discs. The sleeves contacting the surface of the discs reduce the recesses formed by the cutouts in the side surface and formed by the surface of the discs on the path of the cam rollers, thus reducing the moment of resistance to rotation of the shaft of the device; this ensures the possibility of connecting the shaft of the device with the shaft of the mechanism or machine with the aid of a single gear drive or directly, for example, by a coupling. This advantage permits the device to be installed in the mechanism or machine, connecting its shaft directly with a multi-turn shaft of the mechanism or machine, for example, with the worm shaft of a turntable.

In addition, the device increases the range of angular motions of the shaft of the mechanism or machine. For example, in the layout wherein the shaft of the device carries gears Z=35, there are 37 holes in the perforated portion of the first sleeve forming a gear drive with the gear Z=35, 38 holes in the perforated portion of the second sleeve, and 39 holes in the perforated portion of the third sleeve, and, at a speed ratio of 32 between the shaft 16 of the mechanism or machine and the shaft 4 of the device, the maximum permissible angular displacement range of the shaft of the mechanism or machine will be as follows:

with one sleeve, 1 revolution, 56.25°;

with the first and second sleeves, 43 revolutions, 337.5°;

with three sleeves, 1713 revolutions, 202.5°.

By replacing the dividing elements and turning the discs and rings on the shaft of the device, it is possible to change the program of the values of the fixed angular (or linear) positions of the shaft (or operating element) of the mechanism or machine without replacing the parts of said device.

All the versions of the device may be used with any type of switching elements, such as microswitches, photocells pickups, and inductive sensors.

What is claimed is:

1. A programmed switching device for setting an angular position of a shaft of a mechanism, comprising:

a casing;

a shaft of the device installed inside said casing;

a kinematic linkage between said shaft of the device and the shaft of the mechanism the angular position of which is to be set;

switching elements;

a cam-and-lever mechanism comprising an axle and cams with rollers and interacting with said switching elements to ensure operation of the switching elements corresponding to the set angular position of the shaft of the mechanism;

a setting mechanism interconnected with said shaft of the device and comprising:

discs, each provided with a slot and secured on said shaft of the device, and each having a rotation plane;

a dividing element movably installed relative to said shaft of the device and accommodating all said discs;

a kinematic linkage of said dividing element with the shaft of the mechanism;

cutouts located in the side surface of said dividing element, one cutout being provided for each rotation plane of said discs;

said cams of the cam-and-lever mechanism being installed on said axle with provision for rotation of each cam in the rotation plane of the corresponding disc;

said switching elements, each arranged in the rotation plane of the corresponding said disc;

the dimensions of said cutouts of said dividing element and the dimensions of the disc slots corresponding to said cutouts selected to match the size of said rollers of the cam-and-lever mechanism to enable said discs to interact with said corresponding switching elements.

2. A programmed switching device according to claim 1 wherein the dimensions of said cutouts of the dividing element are larger than the dimensions of said disc slots.

3. A programmed switching device according to claim 1 wherein the speed ratio of said kinematic linkage between the shaft of the mechanism and said shaft of the device differs from the speed ratio of said kinematic linkage between the shaft of the mechanism and said dividing element and is selected so that said cutouts of the dividing element coincide with corresponding said slots of the discs only once within the working range of rotation of the shaft of the mechanism.

4. A programmed switching device according to claim 1, said kinematic linkage of said dividing element with the shaft of the mechanism representing an internal gearing, said dividing element being installed eccentrically with respect to said shaft of the device.

5. A programmed switching device according to claim 1, wherein said setting mechanism includes at least one additional dividing element, each said at least one additional dividing element being installed eccentrically with relation to said shaft of the device; and at least one internal gearing;

each said at least one additional dividing element being connected with said shaft of the device by corresponding said at least one internal gearing.

6. A programmed switching device according to claim 1 wherein said dividing element is made in the form of a drum.

7. A programmed switching device according to claim 4 wherein said dividing element is made in the form of a sleeve.

8. A programmed switching device according to claim 4 wherein said internal gearing comprises a gear secured on said shaft of the device inside said dividing element, and a gear rim meshing with said gear and secured on the side surface of said dividing element.

9. A programmed switching device according to claim 4 wherein said internal gearing comprises a gear secured on said shaft of the device inside said dividing element, and a perforated portion on the side surface of said dividing element corresponding to said gear and forming, with said gear, said internal gearing.

10. A programmed switching device according to claim 5 wherein the dimensions of said cutouts in all said dividing elements are larger than the dimensions of said disc slots.

11. A programmed switching device according to claim 5 wherein each said internal gearing comprises a gear secured on said shaft of the device inside of said dividing elements; a gear rim corresponding to said gear and secured on the side surface of said corresponding dividing element.

12. A programmed switching device according to claim 5 wherein said internal gearing comprises one gear secured on said shaft of the device inside said dividing elements, and a perforated portion on the side surface of said dividing element and forming, together with said gear, said internal gearing.

13. A programmed switching device according to claim 5 wherein said internal gearing comprises two gears secured on said shaft of the device inside said dividing elements, and two perforated portions on the side surface of said dividing element and forming, together with said one of said gears corresponding thereto, said internal gearing.

14. A programmed switching device according to claim 5 wherein each of said dividing elements is made in the form of a sleeve.

15. A programmed switching device according to claim 5 comprising aligning rollers and axles of said aligning rollers, secured in said casing parallel to said shaft of the device; said dividing element being external and installed in said aligning rollers.

16. A programmed switching device for setting the angular position of the shaft of a mechanism comprising:

a casing;

a casing shaft installed inside said casing;

a kinematic linkage from said casing shaft to the shaft of the mechanism the angular position of which is to be set;

switching elements;

a cam-and-lever mechanism comprising an axle and cams with rollers and interacting with said switching elements in order to ensure operation of those particular switching elements corresponding to the set angular position of the shaft of the mechanism;

a setting mechanism interconnected with said casing shaft and comprising:

discs, each provided with a slot and secured on said casing shaft, and having respective rotation planes;

aligning rollers secured on said casing;

at least one dividing element installed movably with relation to said casing in said aligning rollers and accommodating said discs;

cutouts located on the side surface of said at least one dividing element, one for the respective rotation plane of each said disc;

washers installed on said casing shaft without freedom of rotation;

a kinematic linkage of each of said at least one dividing element with said casing shaft comprising an internal gearing;

said internal gearing comprising a gear secured on said casing shaft inside said at least one dividing element, and a gear wheel secured on said dividing element;

each said disc forming, with at least one dividing element and the corresponding gears of the internal gearing, a corresponding one of a plurality of groups;

each said group of said plurality of groups being separated from other groups by one of said washers;

the length of said cam rollers of said cam-and-lever mechanism being selected so that each roller overlaps said disc and said at least one dividing element of the same group to which said disc belongs;

said cams of the cam-and-lever mechanism being installed on said axle, each of said cams being rotatable in the rotation plane of said corresponding disc;

said switching elements each being arranged in the rotation plane of said corresponding disc;

the dimensions of said cutouts in said dividing element and the dimensions of said disc slots corresponding to said cutouts matching the dimensions of said roller of said cam-and-lever mechanism for enabling said discs to interact with corresponding said switching elements.

17. A programmed switching device according to claim 16 wherein each dividing element is made in the form of a flat ring integral with said gear wheel of the internal gearing.

18. A programmed switching device according to claim 16 wherein, in each group of said plurality of groups, the speed ratio of the kinematic linkage between the shaft of the mechanism and said casing shaft differs from the speed ratio of the kinematic linkage between the shaft of the mechanism and each of said at least one dividing element, and is selected so that the cutouts of said at least one dividing element of said group coincide with the corresponding slot of the disc only once within the working range of rotation of the shaft of the mechanism.

* * * * *